US007963777B2

(12) United States Patent
Tang et al.

(10) Patent No.: US 7,963,777 B2
(45) Date of Patent: Jun. 21, 2011

(54) FIRST CONNECTOR, SECOND CONNECTOR, AND ELECTRICAL CONNECTING DEVICE

(75) Inventors: Yann Song Tang, Singapore (SG); Bao Chang Chan, Singapore (SG)

(73) Assignee: MEA Technologies Pte. Ltd., Singapore (SG)

( * ) Notice: Subject to any disclaimer, the term of this patent is extended or adjusted under 35 U.S.C. 154(b) by 291 days.

(21) Appl. No.: 12/314,954

(22) Filed: Dec. 19, 2008

(65) Prior Publication Data

US 2009/0170354 A1 Jul. 2, 2009

(30) Foreign Application Priority Data

Dec. 28, 2007 (SG) ..... 200719155-4

(51) Int. Cl.
*H01R 12/00* (2006.01)

(52) U.S. Cl. ..... 439/80

(58) Field of Classification Search ..... 439/80, 439/79, 74, 852, 843, 84
See application file for complete search history.

(56) References Cited

U.S. PATENT DOCUMENTS

| | | | | |
|---|---|---|---|---|
| 5,772,452 | A * | 6/1998 | Aoyama | 439/74 |
| 6,269,539 | B1 * | 8/2001 | Takahashi et al. | 29/883 |
| 6,439,914 | B2 * | 8/2002 | Nimura | 439/352 |
| 2004/0266254 | A1 | 12/2004 | Kuo et al. | |

FOREIGN PATENT DOCUMENTS

JP 11-086987 A 3/1999

* cited by examiner

*Primary Examiner* — Edwin A. Leon
(74) *Attorney, Agent, or Firm* — Rader, Fishman & Grauer PLLC

(57) ABSTRACT

A first connector 9 includes: female contact terminals 10; and a first connector housing 13 having a first connection portion 14 with first receiving holes $\mathbf{14}_1$ to $\mathbf{14}_6$ into each of which the female contact terminal is fitted, and a second connection portion 16 that is bent at a certain angle from the end of the first connection portion and has second receiving holes $\mathbf{16}_1$ to $\mathbf{16}_6$ into each of which the female contact terminal is fitted. The female contact terminal is fitted into at least either of the first connector housing's first or second receiving holes, and the contacting portion of the second contact terminal of the second connector is electrically connected to either the first or second contacting portions of the female contact terminal.

7 Claims, 11 Drawing Sheets

(prior art)

FIRST CONNECTOR, SECOND CONNECTOR, AND ELECTRICAL CONNECTING DEVICE

TECHNICAL FIELD

The present invention relates to a first connector, a second connector, and an electrical connecting device made up of these connectors. More particularly, it relates to a first connector, a second connector, and an electrical connecting device made up of these connectors, wherein by fixing the second connector to a circuit wiring board or other installation member and connecting the first connector to the second connector, it is possible to dispose in particular directions the lead wires emerging from the first connector.

BACKGROUND ART

A circuit wiring board has a structure such that on the surface thereof electronic components of various kinds are mounted such as resistance elements, capacitors and semiconductor circuit elements, the electronic components are electrically connected via a wiring pattern, and a board connector is connected to one terminal end of the wiring pattern. Further, an external connector is connected to the board connector, and through this external connector, power, signals and so forth are supplied to the electronic components on the circuit wiring board, or signals and the like are sent out from the electronic components to the exterior.

Many different types of such board connector and external connector have been developed to date. A typical example of such board connector is disclosed in JP-A-11-86987 issued in Japan.

The electrical connector disclosed in the aforementioned JP-A-11-86987 will now be described with reference to FIG. 11. FIG. 11 illustrates the electrical connector set forth in the aforementioned published patent application, FIG. 11A being an overall perspective view of the electrical connector, FIG. 11B being a longitudinal cross-sectional view of the electrical connector in FIG. 11A, and FIG. 11C being a longitudinal cross-sectional view of another electrical connector.

The electrical connector 30 has multiple contact terminals 34, 35 and a housing 31 that has insertion holes in which the contact terminals are housed. The connector assembly resulting when these parts are assembled together is fixed to a circuit wiring board P. The housing 31 consists of an electrically insulative rectangular block having relatively large breadth, height and depth. In this block, multiple insertion holes 32, 33 are disposed in the widthwise direction in two rows, an upper and a lower. Each row of the insertion holes 32, 33 runs through the block from the front face toward the rear face, and to the fore of such holes there are formed fitting apertures 32*a*, 33*a* into which other contact terminals fit. The two rows, upper and lower, of the insertion holes 32, 33 house the contact terminals 34, 35 of differing lengths. Each of the contact terminals 34, 35 has at one end a contacting portion to which a contact terminal of another connector is connected, and at the other end a connection portion $\mathbf{34}_2$ or $\mathbf{35}_2$ that is electrically connected to the contacts 36 on the board, and a linking portion $\mathbf{34}_1$ or $\mathbf{35}_1$ that links the contacting portion and the connection portion. The whole takes roughly the shape of a letter L and is formed from sheet metal material of good electrical conductivity. The contact terminals 35 that are housed in the upper row of insertion holes 33 have the linking portions $\mathbf{35}_1$ formed long, while the contact terminals 34 that are housed in the upper row of insertion holes 32 have the linking portions $\mathbf{34}_1$ formed short.

Assembly of the electrical connector 30 is completed by inserting and fixing the contact terminals 35 with linking portions formed long into the upper row of insertion holes 33 in the connector housing 31, and the contact terminals 34 with linking portions formed short into the upper row of insertion holes 32 in the connector housing 31. In the assembled connector 30, the connector housing 31 is mounted on the surface of the circuit wiring board P, the connection portions of the contact terminals 34, 35 are connected to the contacts on the board by soldering or the like, and the connector housing is fixed by a fixing unit not shown in the drawings.

With this electrical connector, the contact terminals 34, 35 housed in the connector housing 31 are roughly even with the circuit wiring board, so that the external connector can be inserted into the fitting apertures in a roughly horizontal direction. The contact terminals of the external connector have respective lead wires connected thereto that are drawn out from the external connector's housing, and these lead wires too are disposed in a roughly horizontal direction.

However, sometimes during design of the circuit wiring board, space to draw the lead wires out in a horizontal direction relative to the board cannot be secured, and the wires must be drawn out above the board. The electrical connector 30A in FIG. 11C is so configured that the external connector can be connected above the board. Like the above-described electrical connector 30, the electrical connector 30A has a connector housing 31A and contact terminals 34A, 35A.

Another typical instance of an electrical connector is set forth in U.S. Patent Application Publication No. 2004/0266254. This connector is so configured that the angle of the connection portions can be varied 90 degrees.

Due to the relation between the circuit wiring board and the electrical connector mounted thereon, it may happen that, for convenience of design of the circuit wiring board, the lead wires connected to the electrical connector have to be drawn out in different directions depending on the place where the electrical connector is mounted on the board. If the electrical connector set forth in the foregoing JP-A-11-86987 is used in such a case, two types of the electrical connector 30, 30A with differing contact terminal shapes will be necessary. Using electrical connectors of different types will lead to high cost, and moreover the storage and management of the connectors will be bothersome, as will the tasks of selecting and installing the connectors, since such must be selected according to the place where mounted on the circuit wiring board. Also, once a connector has been installed to the circuit wiring board, it is not possible to alter the direction in which the lead wires are drawn out. In other words, the draw-out direction of the lead wires is fixed for each connector and cannot be altered.

With the electrical connector set forth in U.S. Patent Application Publication No. 2004/0266254, although the angle of the connection portions can be varied 90 degrees, the places of installation to the circuit wiring board are constrained, and thus there are inherent issues similar to the electrical connector described earlier.

SUMMARY

An advantage of some aspects of the present invention is to provide a first connector wherein lead wires connected to contact terminals can be drawn out in two differing directions, selectable as desired.

Another advantage is to provide a first connector wherein the draw-out direction of the lead-wires can, once selected, be changed to the other direction in a simple manner.

Further, another advantage is to provide a second connector to which the first connector is fit-joined, and which can be installed to any desired place on the installation member.

Still further, another advantage is to provide an electrical connecting device wherein the first connector and second connector can be detachably joined, and the lead wires connected to the contact terminals of the first connector can be drawn out in two differing directions, selectable as desired.

According to an aspect of the invention, a first connector has: a first contact terminal constituted of a metallic material of good electrical conductivity, having at one end first and second contacting portions that are contact-connected in two directions to a second contact terminal of a second connector, and having a lead wire connection portion at the other end; and a first connector housing having a first connection portion with one or multiple first receiving holes into each of which the first contact terminal is fitted, and a second connection portion that is bent at a certain angle from the end of the first connection portion and has one or multiple second receiving holes into each of which the first contact terminal is fitted. The first connector housing is constituted of an electrically insulative resin molding provided with an insertion aperture which put into communication the respective ends of the first and second receiving holes and into each of which, at such communication point, the a contacting portion of the second contact terminal is inserted. The first connector housing possesses the innovative feature that the first contact terminal is fitted into at least either of the first connector housing's first or second receiving holes, and the contacting portion of the second contact terminal of the second connector is electrically connected to either the first or second contacting portions of the first contact terminal when the first contact terminal is fitted into each of the receiving holes.

With such first connector of an aspect of the invention, the first contact terminal, which is fitted into at least either of the first or second receiving holes that are provided in the first and second connection portions will be connected to the second contact terminal of the second connector whether fitted into the first or the second receiving holes or into both. Hence, when the first contact terminal has the lead wire connected thereto and are fitted into the first and/or second receiving holes, the lead wire will be drawn out from respectively the first and/or second connection portions, which are provided in differing orientations, and thus it will be possible to select the draw-out direction of the lead wire in a simple manner.

Also, in such first connector, the first connector housing will preferably be formed in the shape of a letter L when viewed from the side, with the first connection portion being provided in one limb of the L and the second connection portion being formed in the other limb, and with the insertion aperture being provided at the angle portion of the L.

With such preferred mode of such first connector, it will be possible, when the first contact terminal with the lead wire connected thereto is fitted respectively into the first and second receiving holes of the first and second contacting portions, to draw out the lead wire connected to the first contact terminal in such a manner that their draw-out directions are perpendicular to each other.

Also, in such first connector, the first and second receiving holes will preferably be provided by partitioning the first and second connection portions into multiple receiving compartments.

With such preferred mode of such first connector, thanks to the first and second receiving holes being provided by partitioning the first and second connection portions into multiple receiving compartments, the first contact terminal, which is fitted into these receiving holes, can be electrically insulated from each other.

Also, in such first connector, the receiving compartments will preferably have a particular inner diameter and length, and on the inner walls thereof there will preferably be provided latching portions that latch onto the first contact terminal, and release holes for detaching the first contact terminal from the first connector housing.

With such preferred mode of such first connector, latching and detaching of the first contact terminal can be effected in a simple manner, thanks to the receiving compartments having a particular inner diameter and length, and to there being provided on the inner walls thereof the latching portions that latch onto the first contact terminal, and the release holes for detaching the first contact terminal from the first connector housing. Thus, even after having the lead wire connected and being fitted into the first connector housing, the first contact terminal can be detached in a simple manner, enabling the contacting position thereof and the draw-out directions of the lead wire to be altered.

Also, in such first connector, the first connector housing will preferably have, on the outer surface either of the part where the first connection portion is provided, or of the part where the second connection portion is provided, a latching unit that detachably latches onto the latching portion of the second connector.

With such preferred mode of such first connector, the first connector housing will, thanks to there being provided, either on the outer surface thereof where the first connection portion is provided or that where the second is provided, the latching unit that detachably latches onto the latching portion of the second connector, be of a structure such as to be installable/detachable to/from the second connector in a simple manner.

Also, in such first connector, the first contacting portion of the first contact terminal will preferably be formed as first and second contact tongues having a particular length and width and whose tip portions are disposed so as to oppose each other, either in contact or across a narrow gap, and the second contacting portion of the first contact terminal will be formed at the longitudinal tip portion of the first contacting portion so as to be oriented orthogonally to such longitudinal direction.

With such preferred mode of such first connector, the first contact terminal can be contact-connected to the second connector's second contact terminal from two directions.

According to another aspect of the invention, a second connector that is fit-connected to the first connector includes: a second contact terminal constituted of a metallic material of good conductivity and having first and second contact parts that are connected to the first and second contacting portions of the first contact terminal; and a second connector housing that has a base to which multiple second contact terminals are fitted, is mounted and fixed to an installation member, and is constituted of an electrically insulative resin molding. The second connector possesses the innovative feature that the second connector housing has a fitting aperture formed in the base, and the second contact terminal is fitted into such fitting apertures in a direction orthogonal to the plane of the base.

With such second connector, no matter to what place on the installation member the second connector is installed, when the first connector is connected to the second connector it will be possible to draw out the lead wire from the first connector in differing directions.

Also, in such second connector, the second connector housing will preferably have a latching portion that latches onto the first connector's latching unit.

With such preferred mode of such second connector, the formation of the latching portion that latches onto the latching unit provided in the first connector facilitates connection to and detachment from the first connector.

According to a further aspect of the invention, an electrical connecting device is composed of the foregoing first connector and the foregoing second connector.

With such further aspect, there can be provided an electrical connecting device in which the lead wire can be drawn out in differing directions.

BRIEF DESCRIPTION OF THE DRAWINGS

The invention will be described with reference to the accompanying drawings, wherein the same numerals refer to the same elements throughout.

DESCRIPTION OF EXEMPLARY EMBODIMENT

An exemplary embodiment of the present invention will now be described with reference to the accompanying drawings. It should be understood however that the following embodiment is intended by way of example of a first connector, second connector and electrical connecting device that realize the technical concepts of the invention, not by way of limiting the invention to this particular first connector, second connector and electrical connecting device. The invention can equally well be adapted to carry out other embodiments within the scope and spirit of the claims.

First Embodiment

Figure 1:
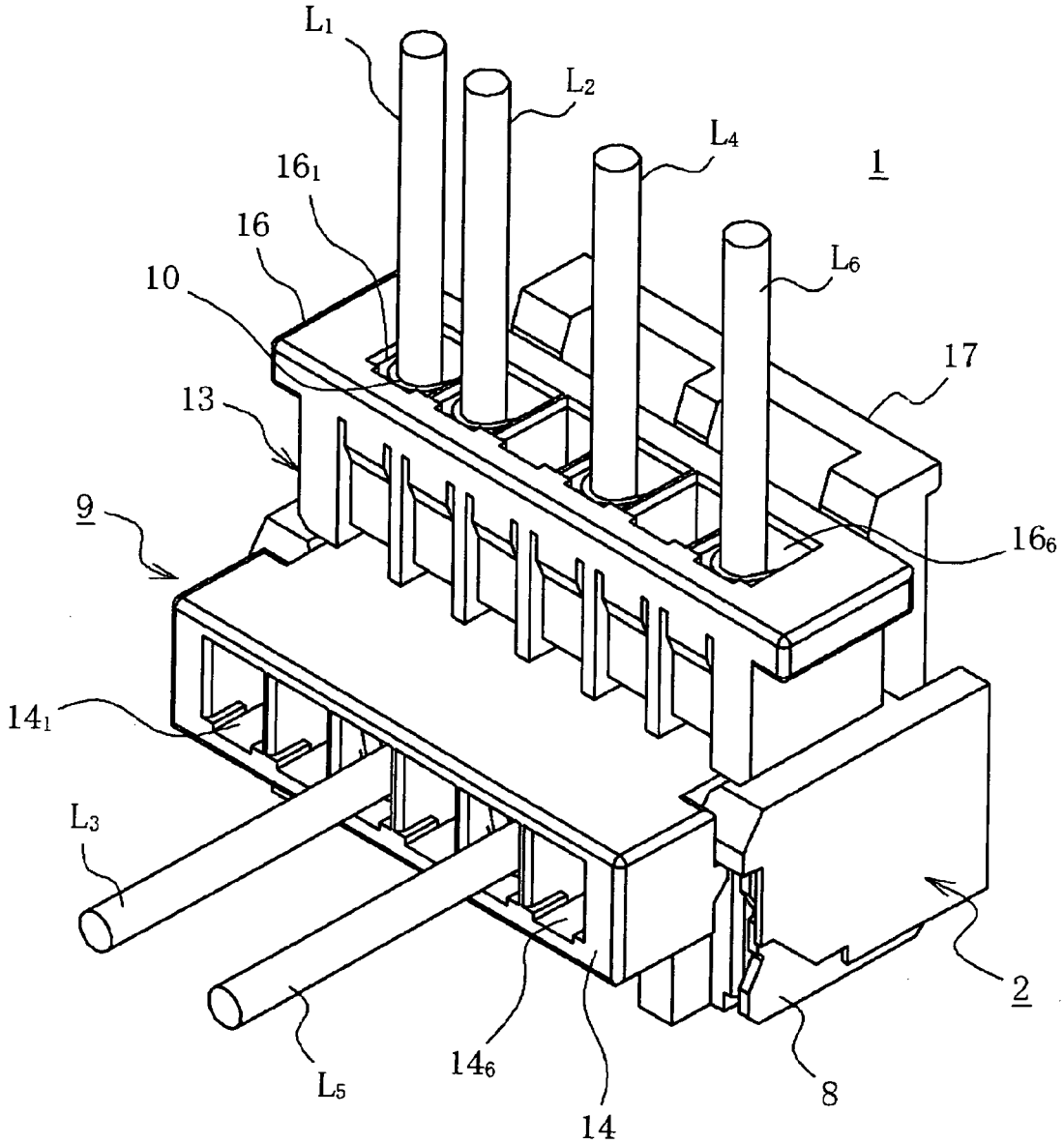
FIG. 1 is a perspective view of an electrical connecting device of an embodiment of the invention.
Figure 2A:
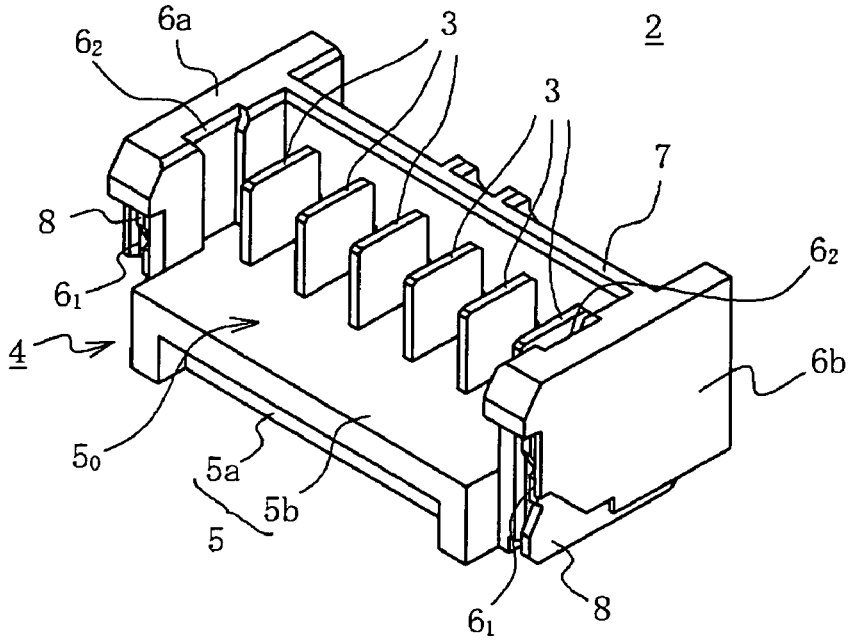
FIG. 2 illustrates a male connector that is a component of the electrical connecting device in FIG. 1, FIG. 2A being a perspective view thereof, FIG. 2B being a front view thereof, and FIG. 2C being a cross-sectional view through line IIC-IIC in FIG. 2B.
Figure 2B:
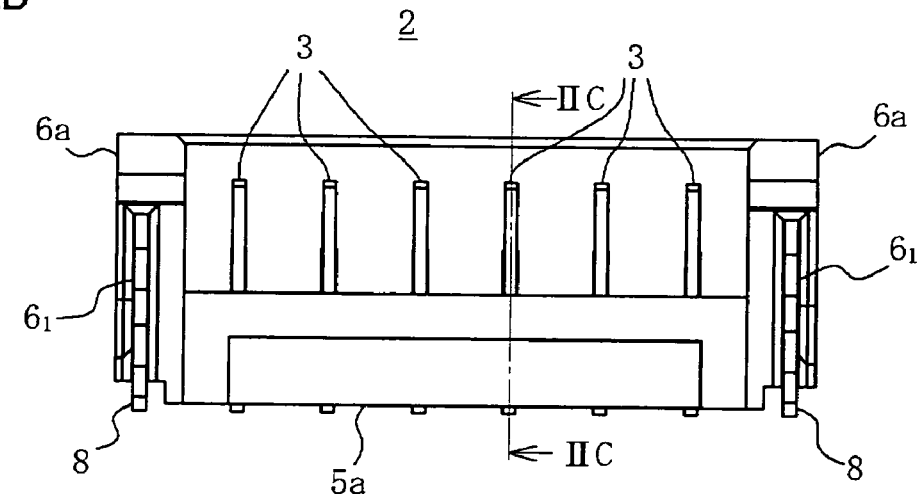
Figure 2C:
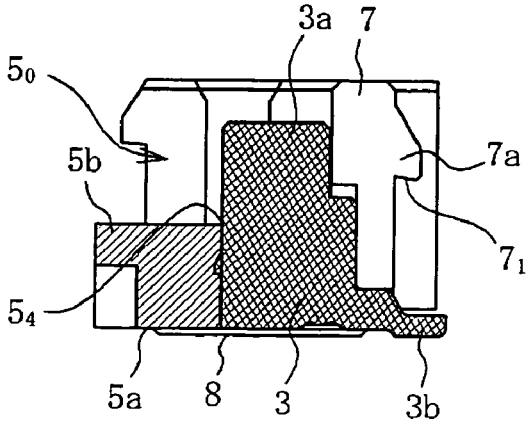
Figure 3A:
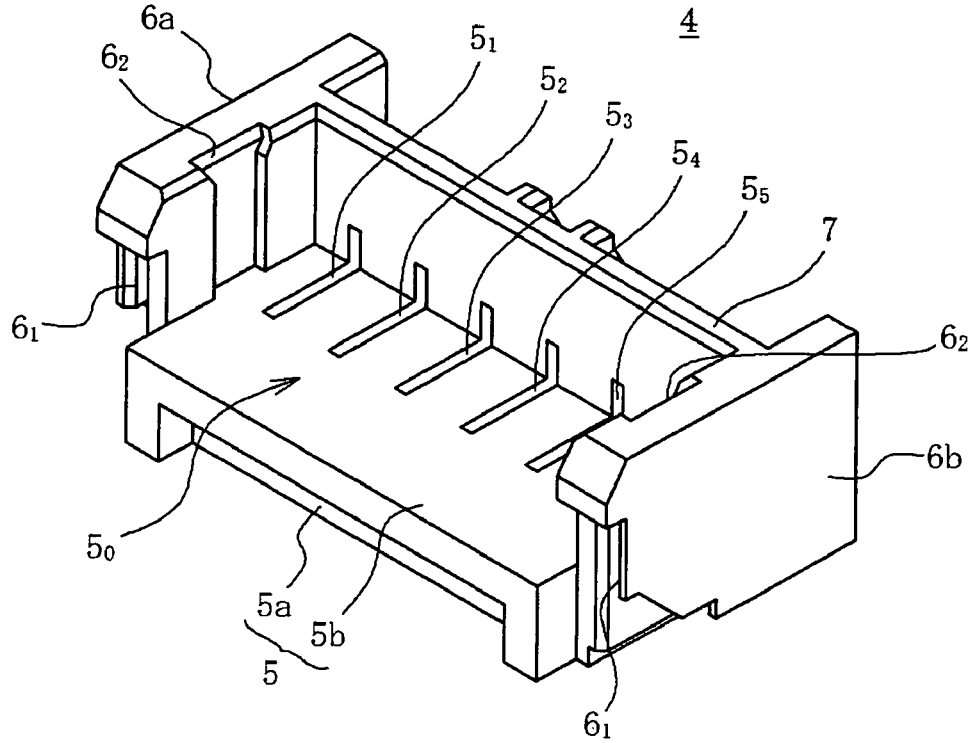
FIG. 3 illustrates a male connector housing, FIG. 3A being a perspective view thereof and FIG. 3B a rear view.
Figure 3B:
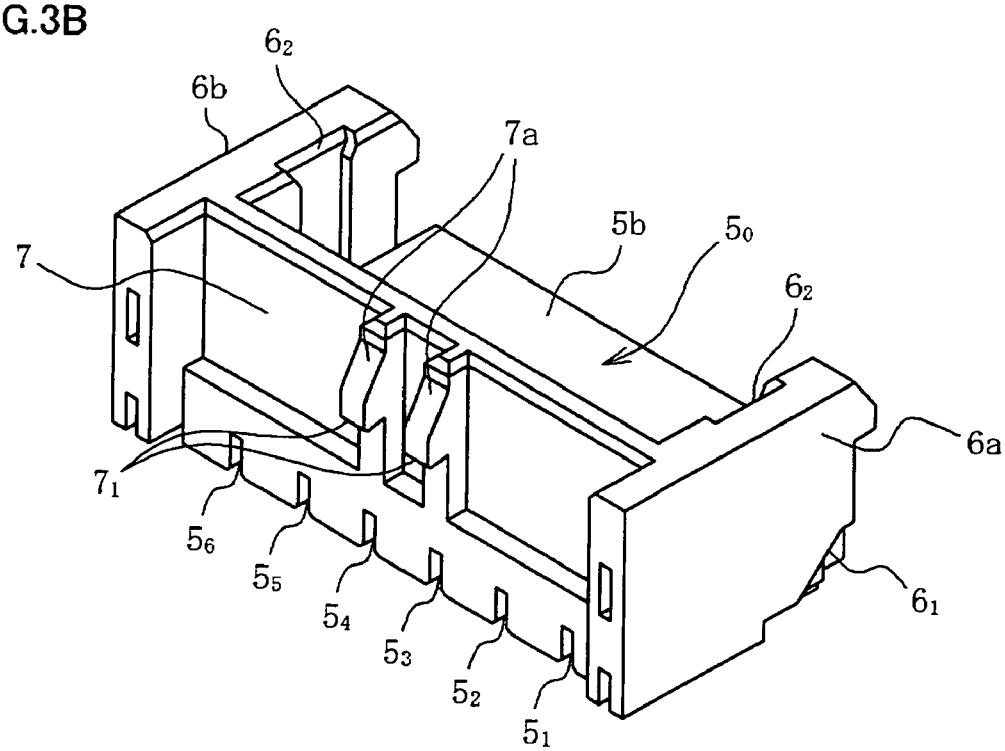
Figure 4A:
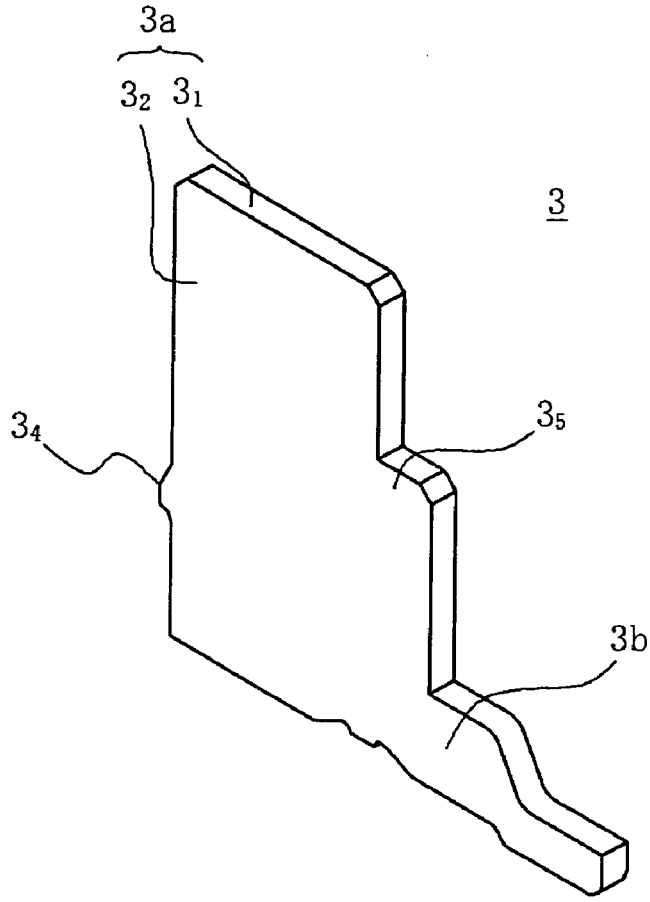
FIG. 4 illustrates a male contact terminal and reinforcing tab that are components of the male connector in FIG. 2, FIG. 4A being a perspective view of the male contact terminal and FIG. 4B being a perspective view of the reinforcing tab.
Figure 4B:
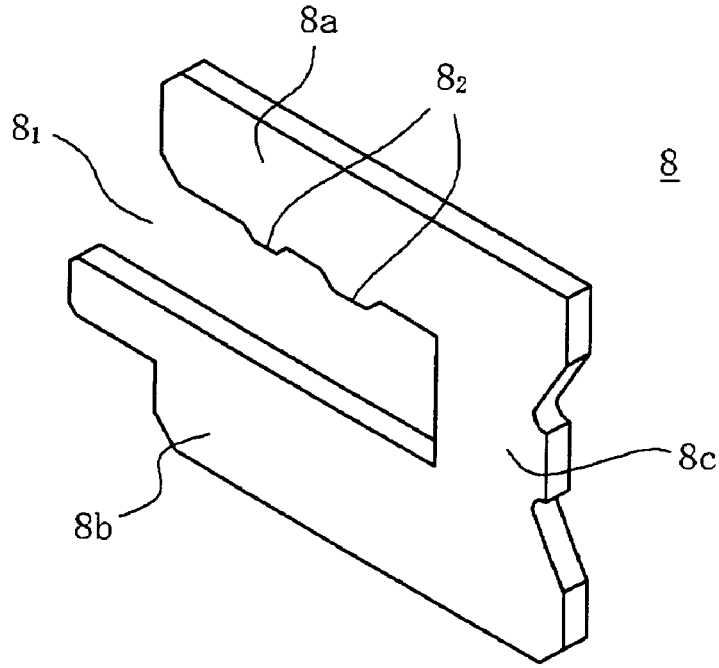
Figure 5A:
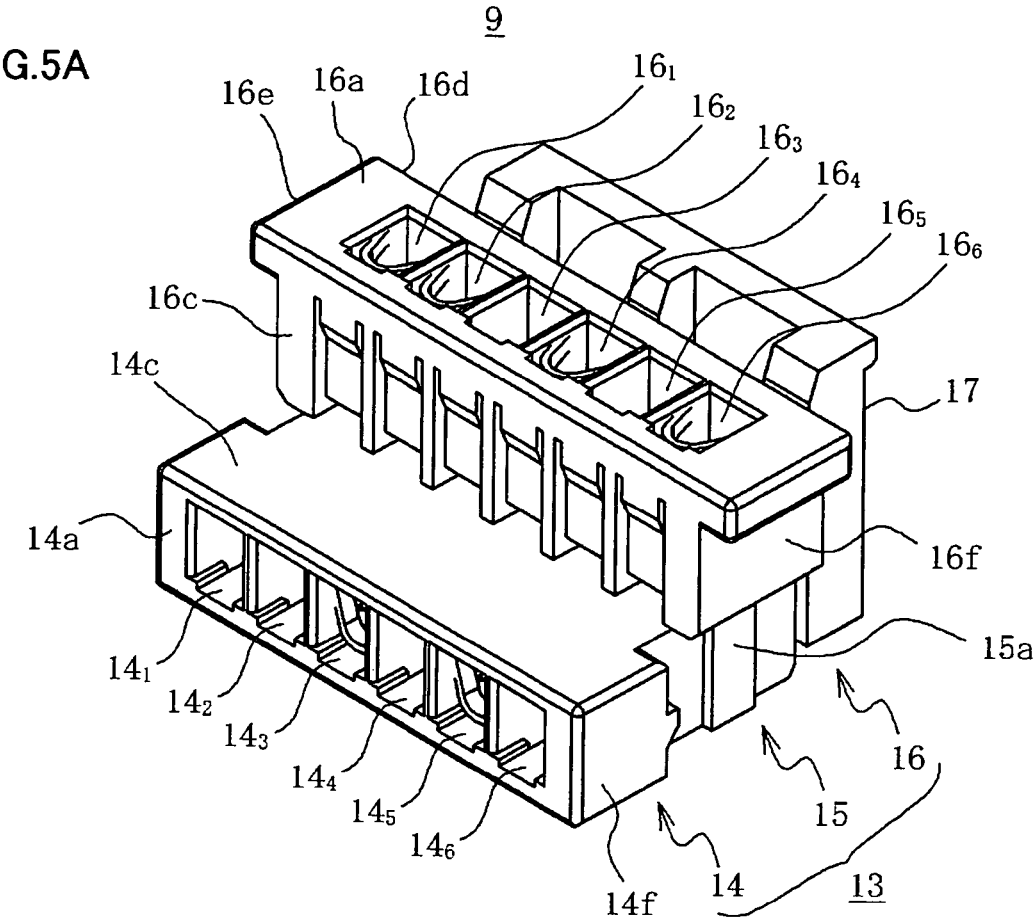
FIG. 5 illustrates a female connector that is a component of the electrical connecting device in FIG. 1, FIG. 5A being a perspective view thereof and FIG. 5B being a front view.
Figure 5B:
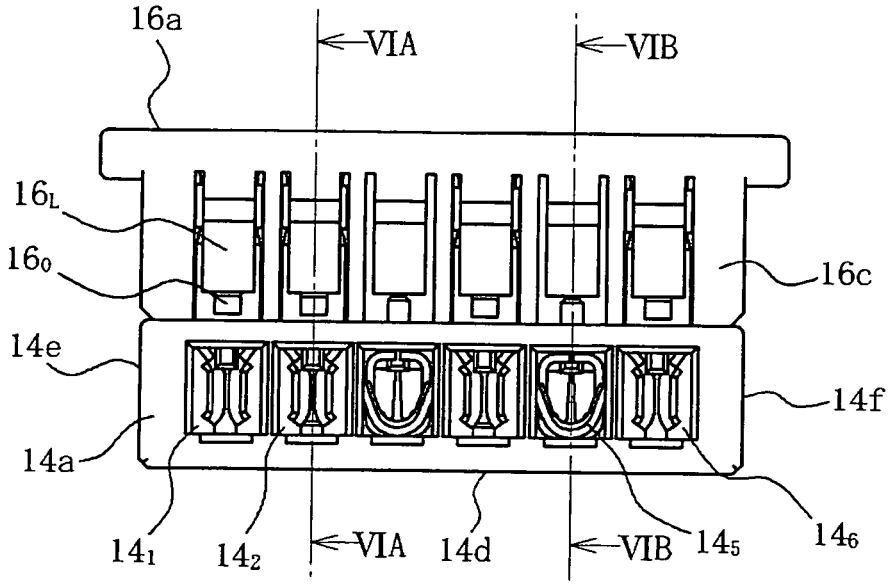
Figure 6A:
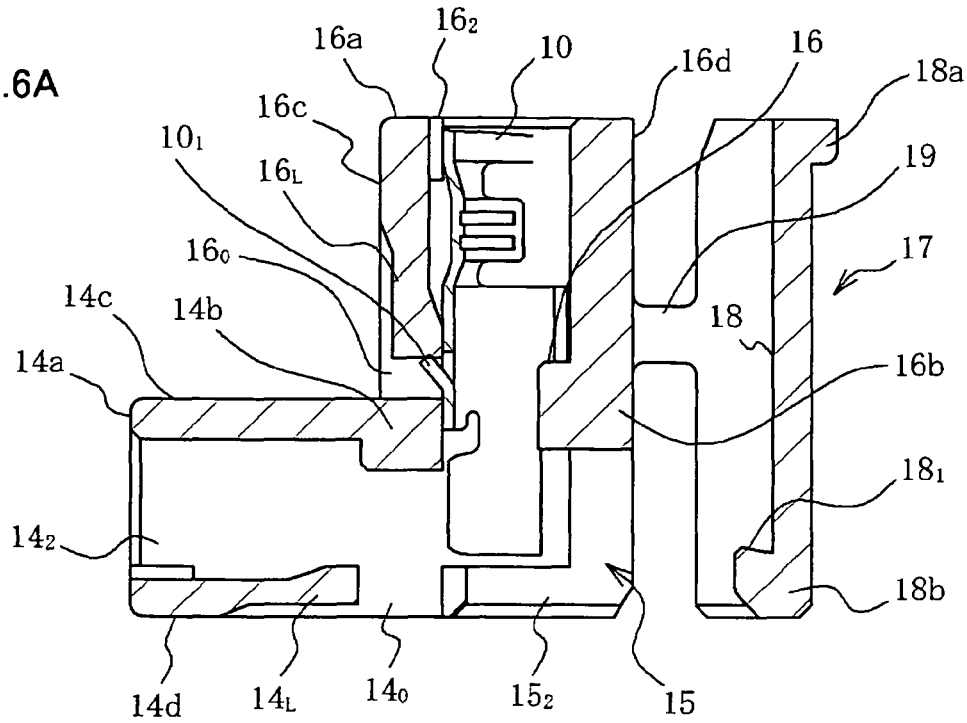
FIG. 6A is a cross-sectional view through line VIA-VIA in FIG. 5B, and FIG. 6B a cross-sectional view through line VIB-VIB in FIG. 5B.
Figure 6B:
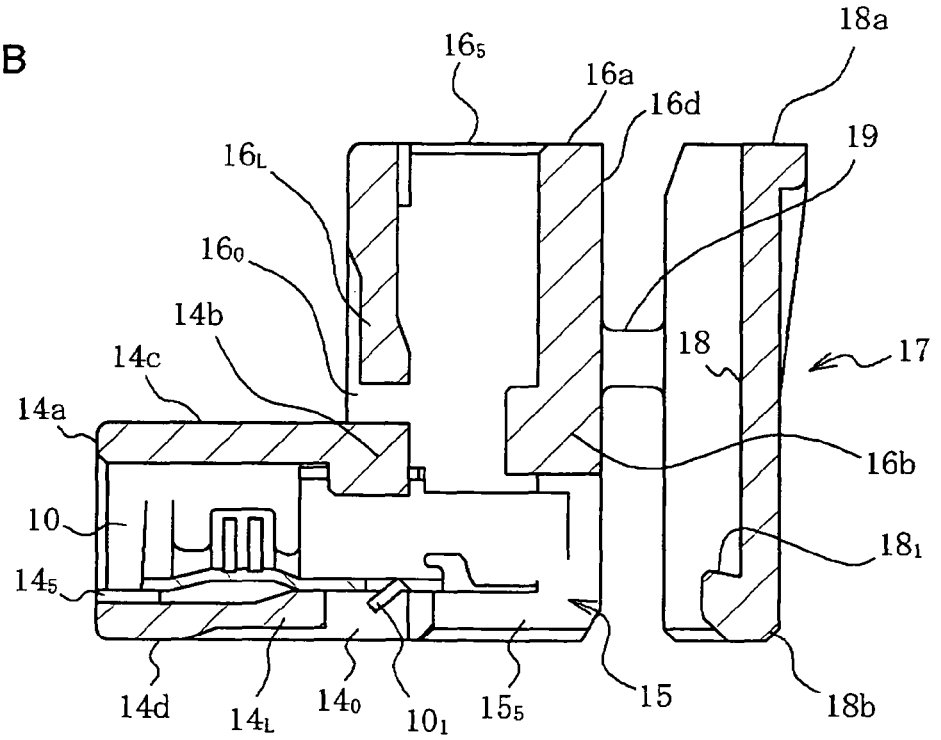
Figure 7A:
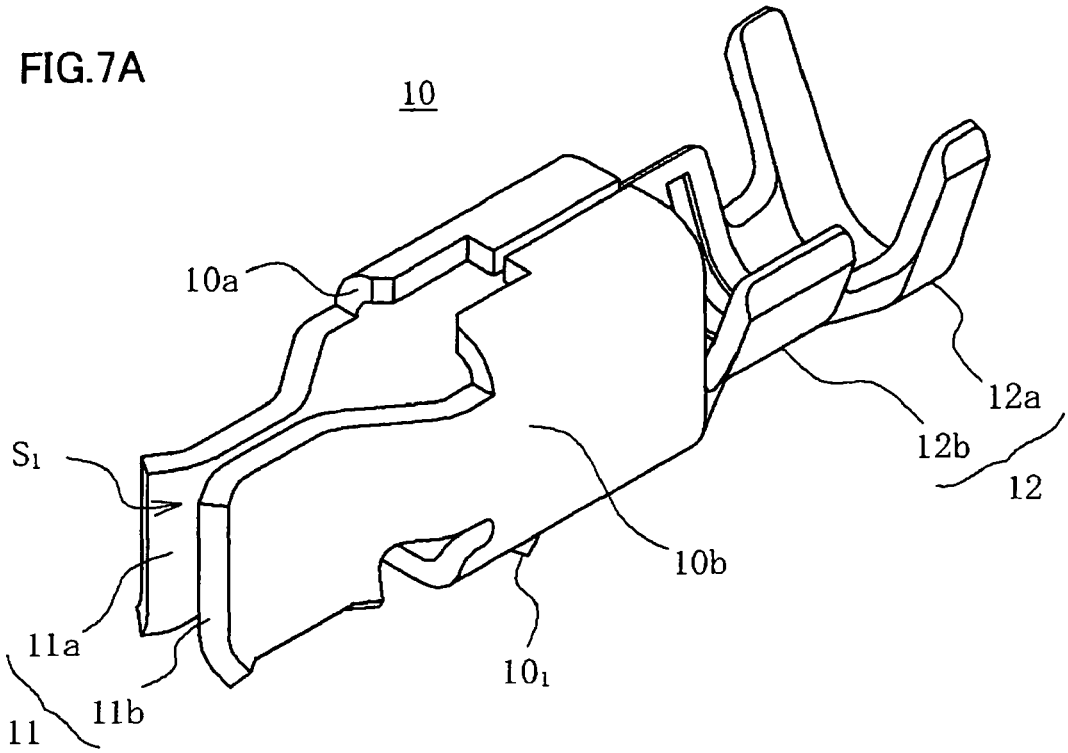
FIG. 7 illustrates a female contact terminal that is a component of the female connector in FIG. 5, FIG. 7A being a perspective view thereof and FIG. 7B a front view.
Figure 7B:
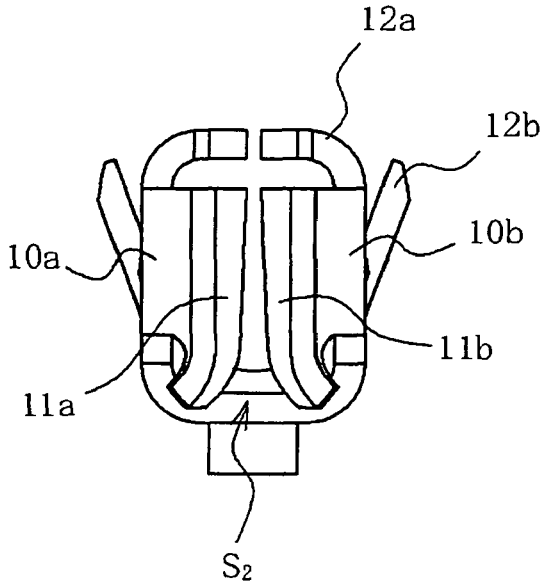
Figure 8A:
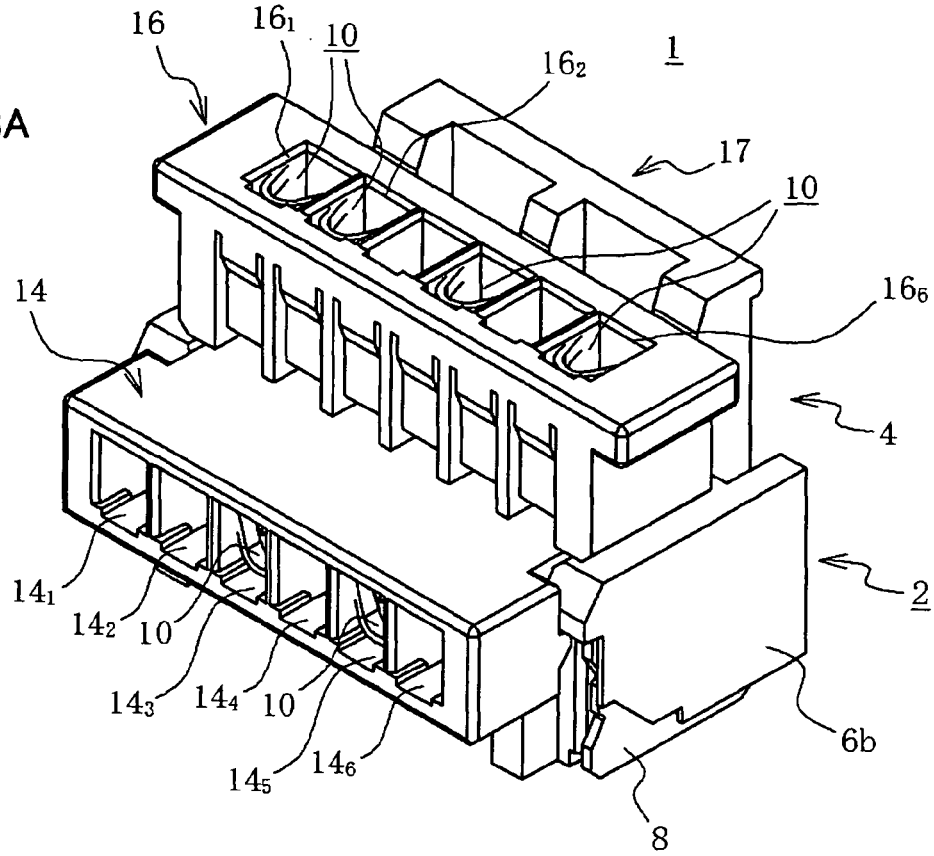
FIG. 8 illustrates the male connector and female connector in the connected state, FIG. 8A being a perspective view thereof and FIG. 8B a front view.
Figure 8B:
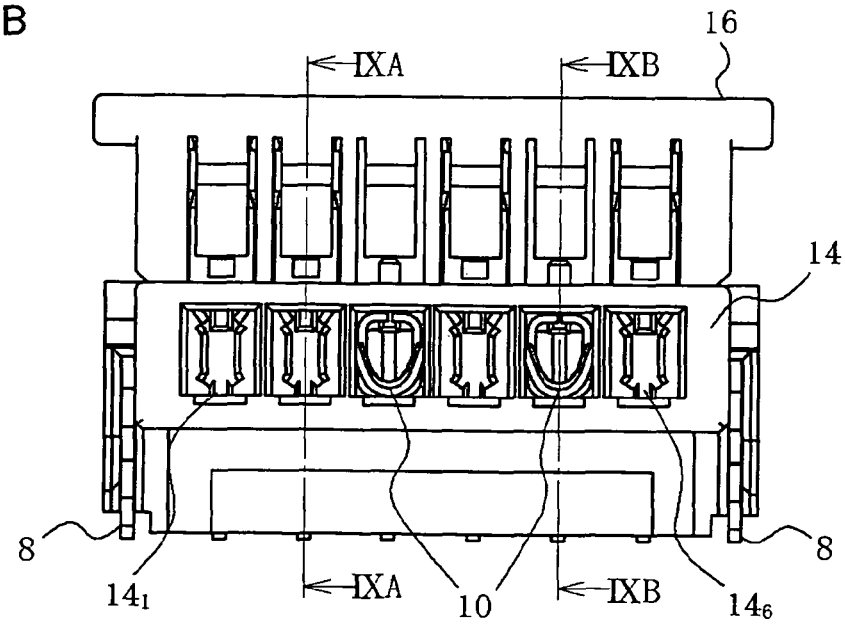
Figure 9A:
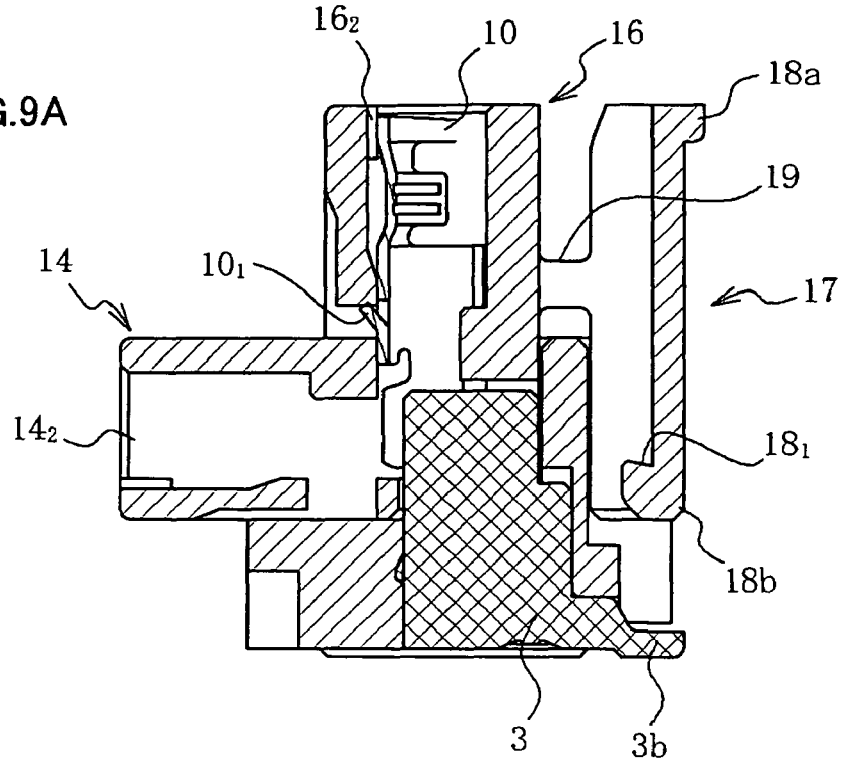
FIG. 9A is a cross-sectional view through line IXA-IXA in FIG. 8B, and FIG. 9B a cross-sectional view through line IXB-IXB in FIG. 8B.
Figure 9B:
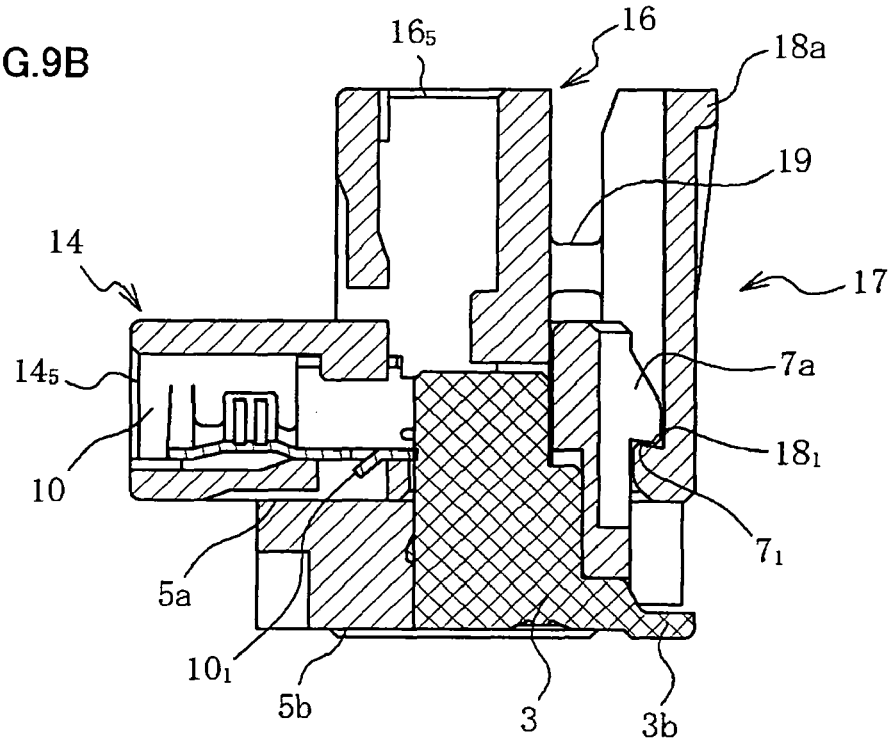

FIG. 1 is a perspective view of an electrical connecting device of an embodiment of the invention. FIG. 2 illustrates a male connector that is a component of the electrical connecting device in FIG. 1, FIG. 2A being a perspective view thereof, FIG. 2B being a front view thereof, and FIG. 2C being a cross-sectional view through line IIC-IIC in FIG. 2B. FIG. 3 illustrates a male connector housing, FIG. 3A being a perspective view thereof and FIG. 3B a rear view. FIG. 4 illustrates a male contact terminal and reinforcing tab that are components of the male connector in FIG. 2, FIG. 4A being a perspective view of the male contact terminal and FIG. 4B being a perspective view of the reinforcing tab. FIG. 5 illustrates a female connector that is a component of the electrical connecting device in FIG. 1, FIG. 5A being a perspective view thereof and FIG. 5B being a front view. FIG. 6A is a cross-sectional view through line VIA-VIA in FIG. 5B, and FIG. 6B a cross-sectional view through line VIB-VIB in FIG. 5B. FIG. 7 illustrates a female contact terminal that is a component of the female connector in FIG. 5, FIG. 7A being a perspective view thereof and FIG. 7B a front view. FIG. 8 illustrates the male connector and female connector in the state where they are connected together, FIG. 8A being a perspective view thereof and FIG. 8B a front view. FIG. 9A is a cross-sectional view through line IXA-IXA in FIG. 8B, and FIG. 9B a cross-sectional view through line IXB-IXB in FIG. 8B. FIG. 10 provides perspective views of the electrical connecting device that show examples of how lead wires can be drawn out.

First of all, the structure of the electrical connecting device of the present embodiment will be described in outline.

As FIGS. 1 and 8 show, the electrical connecting device of this embodiment has a male connector 2 which serves as the second connector and is installed to a circuit wiring board or the like, and a female connector 9 which serves as the first connector and is detachably joined to the male connector 2. The female connector 9 has a female connector housing ("female housing" below) 13 that serves as the first connector housing and is roughly L-shaped when viewed from the side. The female housing 13 is provided with first and second connection portions 14 and 16, and male contact terminals 10 serving as the multiple first contact terminals are fitted, with lead wires $L_1$ to $L_6$ attached thereto, into either first or second set of receiving holes, $\mathbf{14}_1$ to $\mathbf{14}_6$, or $\mathbf{16}_1$ to $\mathbf{16}_6$, that are provided in first and the second contact portions 14 and 16 respectively. Thanks to such structure, the lead wires $L_1$ to $L_6$ connected to the female contact terminals 10 can be drawn out selectively in a horizontal direction and/or a vertical direction. In more detail, the draw-out directions for the lead wires $L_1$ to $L_6$ could for example be as shown in FIG. 1, where the four lead wires $L_1$ $L_2$, $L_4$ and $L_6$ are drawn out in a vertical direction and the remaining two lead wires $L_3$ and $L_5$ in a horizontal direction. Those of the lead wires $L_1$ to $L_6$ that are attached to the female contact terminals 10 inserted into certain of the first connection portion 14's receiving holes $\mathbf{14}_1$ to $\mathbf{14}_6$ are drawn out in a horizontal direction, and those that are attached to the female contact terminals 10 inserted into certain of the second connection portion 16's receiving holes $\mathbf{16}_1$ to $\mathbf{16}_6$ are drawn out in a vertical direction.

With this electrical connecting device 1, no matter whether the male connector 2 is installed on an edge portion or the central portion of the circuit wiring board, the lead wires emerging from the female connector 9 can, when the female connector 9 is joined to the male connector 2, be drawn out in a horizontal and/or vertical direction relative to the plane of the circuit wiring board. This means that the degree of freedom in the location of installation to the circuit wiring board is increased, and as a result, design of the circuit wiring board is rendered easier.

The structures of the male connector 2 and the female connector 9 that are components of the aforementioned electrical connecting device 1 will next be described in turn with reference to FIGS. 2 to 7.

The structure of the male connector 2 is described first, with reference to FIGS. 2 to 4.

The male connector 2 has multiple—say 6—male contact terminals 3 that serve as the second contact terminals, and a male connector housing ("male housing" below) 4 that serves as the first connector housing and into which the male contact terminals 3 are fitted. The connector assembly assembled from these parts is fixed to a circuit wiring board (omitted from the drawings).

The male housing 4 has: a base portion 5 with a relatively large breadth and a particular height and depth; lateral wall portions 6*a* and 6*b* that rise up vertically from the two lateral edges of the base portion 5; an inner wall portion 7 that extends breadthwise so as to link up the pair of lateral wall portions 6*a*, 6*b* and rises up vertically from the base portion 5; and an open portion $\mathbf{5}_0$ in front of the inner wall portion 7; and is formed as a molding of electrically insulative synthetic resin material. The base portion 5 is composed of a rectangular bottom 5*a* that has a flat surface that mounts onto the surface of the circuit wiring board, and a base 5*b* that is located above the bottom 5*a* and has a particular thickness. As FIGS. 3A and 3B show, in the base 5*b* there are formed six fitting apertures $\mathbf{5}_1$ to $\mathbf{5}_6$ into which the six male contact terminals 3 are fitted. These fitting apertures $\mathbf{5}_1$ to $\mathbf{5}_6$ are formed as slits that penetrate through the base 5*b* from top to bottom. More precisely, the fitting apertures $\mathbf{5}_1$ to $\mathbf{5}_6$ formed as slits are arranged at roughly equal spacing in the base 5*b*, with one extremity of each of the fitting apertures $\mathbf{5}_1$ to $\mathbf{5}_6$ reaching the inner wall 7, penetrating though the base 5*b* and the inner wall 7, and with the part that penetrates through the inner wall 7 reaching the place where the lower portion of the inner wall 7 joins up with the bottom 5*a* (see FIG. 3B). It is this part through which the terminal portions 3B of the male contact terminals 3 are drawn (see FIG. 2C).

Also, as FIGS. 2 and 3 show, the pair of lateral wall portions 6*a*, 6*b* are constituted of plate-form bodies having a particular thickness, and in these plate-form bodies there are formed installation holes $\mathbf{6}_1$, $\mathbf{6}_1$ into which the reinforcing tabs 8 are fitted. In each of the opposed faces of the lateral wall portions 6*a*, 6*b* there is formed a guide slot $\mathbf{6}_2$, $\mathbf{6}_2$. Also, as FIG. 3B shows, the inner wall portion 7 is constituted of plate-form body having a particular thickness, and approximately at the central portion of the rear face thereof, two slab-like protuberances 7*a*, 7*a* are formed in a direction orthogonal to the longitudinal direction of the male housing 2. On these slab-like protuberances 7*a*, 7*a* there are formed latching stepped portions $\mathbf{7}_1$, $\mathbf{7}_1$ that latch with a latching unit of the female connector 9.

As FIG. 4 shows, each male contact terminal 3 has a blade-shaped contacting portion 3*a* with a particular width and length, and a terminal portion 3*b* that is bent roughly at right angles from the bottom edge of the contacting portion 3*a*, the whole being formed from sheet metal material of a particular thickness and good conductivity, and taking the rough form of an L-shape when viewed from the side. The contacting portion 3*a* has two contact parts (first and second) $\mathbf{3}_1$, $\mathbf{3}_2$, the first contact part $\mathbf{3}_1$ being formed at the top of the L-shaped male contact terminal 3 and the second contact part $\mathbf{3}_2$ being formed at a side face thereof. Also, the contacting portion 3*a* has a latching protrusion $\mathbf{3}_4$ formed on one end edge and a latching shoulder $\mathbf{3}_5$ on another. The terminal portion 3*b* is connected by soldering to a contact provided on the circuit wiring board not shown in the drawings.

The reinforcing tabs 8 are reinforcing members for rendering firm the installation of the male housing 4, and are connected by soldering to the circuit wiring board not shown in the drawings when the male connector 2 is mounted and fixed thereto. As FIG. 4B shows, each reinforcing tab 8 has a pair of opposed top and bottom fingerlike pieces 8*a*, 8*b*, a linking piece 8*c* that joins up the fingerlike pieces 8*a*, 8*b* at one end thereof, and an opening $\mathbf{8}_1$ where the other ends thereof are left open, the whole being formed from sheet metal material in the rough form of a letter U lying on its side. The reinforcing tabs 8 are of a thickness such as to be press-fitted into the installation holes $\mathbf{6}_1$, $\mathbf{6}_1$ in the two lateral wall portions 6*a*, 6*b*. Each fingerlike piece 8*a*, 8*b* has a particular width, and in the sidewall surface of one fingerlike piece 8*a* there are provided latching portions $\mathbf{8}_2$ that are positioned and fixed inside the installation holes $\mathbf{6}_1$.

Next, assembly of the male connector 2 will be described with reference to FIGS. 2 to 4.

First, the male contact terminals 3 are fitted into the respective fitting holes $\mathbf{5}_1$ to $\mathbf{5}_6$ in the male housing 4 shown in FIG. 3A. Such fitting of the male contact terminals 3 is done by press-fitting the tops thereof into the fitting holes (slits) $\mathbf{5}_1$ to $\mathbf{5}_6$ through the bottom 5*a* of the male housing 4, and latching the latching part $\mathbf{3}_1$ and shoulder part $\mathbf{3}_2$ of the male contact terminals 3 to the latching parts (see FIG. 2C) inside the slits so as to position and fix the male contact terminals 3. Through such fitting, the male contact terminals 3 are fixed inside the fitting holes $\mathbf{5}_1$ to $\mathbf{5}_6$ with the contacting portions 3*a* protruding above the base 5*b*, as shown in FIGS. 2A and 2C. Also, the reinforcing tabs 8, 8 are press-fitted into and fixed in the installation holes $\mathbf{6}_1$, $\mathbf{6}_1$ in the lateral wall portions 6*a*, 6*b* of the male housing 4. With the foregoing processes, assembly of the male connector 2 is complete.

The assembled male connector 2 is mounted on a circuit wiring board not shown in the drawings, and is fixed thereto by soldering the terminal portions 3*b* of the male contact terminals 3 to the contacts on the circuit wiring board, and also by soldering the reinforcing tabs 8, 8 to the circuit wiring board.

The structure of the female connector 9 will now be described with reference to FIGS. 5 to 7.

The female connector 9 includes six female contact terminals 10—the same quantity as the male contact terminals 3 of the male connector 2—and a female housing 13 in which the female contact terminals 10 are fitted and which is constituted of an electrically insulative synthetic resin molding having the rough shape of a letter L when viewed from the side. The connector assembly assembled from these parts is detachably fixed to the male connector 2.

As FIG. 5 shows, the female housing 13 includes: the first connection portion 14 with the first set of six receiving holes $\mathbf{14}_1$ to $\mathbf{14}_6$ capable of receiving the six female contact terminals 10; the second connection portion 16 that is bent roughly at right angles from the end portion of the first connection portion 14 and has the second set of receiving holes $\mathbf{16}_1$ to $\mathbf{16}_6$ capable of receiving the same quantity (six) of female contact terminals 10 as the first connection portion 14; and a linking part 15 that joins up the first and second connection portions 14, 16. Each of the first set of receiving holes $\mathbf{14}_1$ to $\mathbf{14}_6$ communicates with its respective counterpart among the second set of receiving holes $\mathbf{16}_1$ to $\mathbf{16}_6$ in the interior of the female housing 13, and moreover, in the linking part 15, at the points where the respective counterparts of the first and second sets of receiving holes $\mathbf{14}_1$ to $\mathbf{14}_6$ and $\mathbf{16}_1$ to $\mathbf{16}_6$ converge, there are provided six insertion apertures $\mathbf{15}_1$ to $\mathbf{15}_6$ (see FIG. 6) into which the male connector 2's male contact terminals 3 are inserted. Also, as the female housing 13 is constituted of a roughly L-shaped synthetic resin molding, the linking part 15 that joins up the first and second connection portions 14, 16 constitutes the angle portion of the L.

As FIG. 5 shows, the first connection portion 14 is constituted of an oblong block having a front face 14*a*, top and bottom faces 14*c*, 14*d*, and lateral faces 14*e*, 14*f*, while the second connection portion 16 is constituted of a rectangular block having a top face 16*a* and front, rear and lateral faces 16*c* to 16*f*. As FIG. 6 shows, the rear part 14*b* of the first connection portion 14 and the lower part 16*b* of the second connection portion 16 are conjoined at right angles by the linking part 15. The first connection portion 14's six first receiving holes $\mathbf{14}_1$ to $\mathbf{14}_6$ are formed from the front wall 14*a* toward the rear part 14*b*, and extend up to the linking part 15, as shown in FIG. 6. More precisely, the first receiving holes $\mathbf{14}_1$ to $\mathbf{14}_6$ are formed by partitioning the first connection portion 14, which is constituted of an oblong block, into receiving compartments of a particular size. On the inner walls of the first receiving holes $\mathbf{14}_1$ to $\mathbf{14}_6$ there are provided positioning-fixing portions by which the female contact terminals 10 are positioned and fixed. These positioning-fixing portions are made up of latching pieces $\mathbf{14}_L$ and the like onto which the latching tabs $\mathbf{10}_1$ of the female contact terminals 10 latch. Also, in the first receiving holes $\mathbf{14}_1$ to $\mathbf{14}_6$ there are formed detaching holes $\mathbf{14}_0$ for releasing the female contact terminals 10 via insertion and manipulation of a tool. The six second receiving holes $\mathbf{16}_1$ to $\mathbf{16}_6$ are formed from the top wall 16*a* toward the lower part 16*b*, and extend up to the linking part 15, as shown in FIG. 6. Similarly to the first connection portion 14's the first receiving holes $\mathbf{14}_1$ to $\mathbf{14}_6$, the second receiving holes $\mathbf{16}_1$ to $\mathbf{16}_6$ are formed by partitioning the second connection portion 16, which is constituted of a rectangular block, into receiving compartments of a particular size. Since the first and second receiving holes $\mathbf{14}_1$ to $\mathbf{14}_6$ and $\mathbf{16}_1$ to $\mathbf{16}_6$ are all partitioned off from each other, no electrical contacting will occur between adjacent contact terminals when the contact terminals are fitted into these receiving holes.

In the linking part 15 that joins up the first and second connection portions 14 and 16, there are formed six insertion apertures $\mathbf{15}_1$ to $\mathbf{15}_6$ into which the male connector 2's male contact terminals 3 are inserted. FIG. 6 shows two of these insertion apertures, $\mathbf{15}_2$ and $\mathbf{15}_5$. Also, in the lateral walls of the linking part 15 there are formed guide protrusions 15*a*, 15*a* that are inserted into the guide slots $\mathbf{6}_2$, $\mathbf{6}_2$ in the male connector 2.

On the rear wall 16*d* of the second connection portion 16 there is provided a latching unit 17 that engages with and separates from the male connector 2 via the mediation of a linking part 19 of a particular length. This latching unit 17 has a manipulation plate 18 of roughly the same size as the rear wall 16*d*. The bottom edge portion 18*b* of the manipulation plate 18 has a latching ledge $\mathbf{18}_1$, and the top edge portion forms a manipulation part 18*a*. This manipulation plate 18 is joined by means of a short, thick linking part 19, and therefore is able to be rocked, with the linking part 19 serving as support point. To effect engagement with the male connector 2, the female connector 9 is inserted into the male connector 2, whereupon the bottom part 18*b* of the manipulation plate 18 moves down over the inclined faces of the male connector 2's slab-like protuberances 7*a*, and when the bottom part moves past the top parts of the inclined faces, the latching ledge $\mathbf{18}_1$ is propelled toward the rear wall 16*d* by the resilience of the manipulation plate 18, and latches onto the latching stepped portions $\mathbf{7}_1$. Through such latching, the female connector 9 is coupled to the male connector 2 and will not come out even if pulled upward. On the other hand, when the two connectors are to be separated, the manipulation part 18*a* will be gripped with the fingers and pushed against the rear wall 16*d*, whereupon the manipulation plate 18 will move in the opposite direction using the linking part 19 as support point, and the latching stepped portions $\mathbf{7}_1$ of the male connector 2 will be released from the latching ledge $\mathbf{18}_1$, so that the female connector 9 can be pulled out, and separation thereby effected.

The female contact terminals 10, as FIG. 7 shows, have a contacting portion 11 that is formed at one end, a connection portion 12, to which lead wires are connected, that is formed at the other end, and a shell portion 10*b* that links the contacting portion 11 and connection portion 12; and are formed by bend-processing of sheet metal material of good electrical conductivity. The contacting portion 11 is constituted of a pair of elastic tongues 11*a*, 11*b* of a particular length and possessing resilience, that extend forward from the shell portion 10*b*. These elastic tongues 11*a*, 11*b* each have a particular width and are disposed with their flat faces opposed to each other and either in contact or separated by a slender gap.

In the contacting portion 11 there are formed a first and a second insertion portion $S_1$, $S_2$ into which the male contact terminals 3 of the male connector 2 are inserted from two differing directions. The first insertion portion $S_1$ is formed at the longitudinal tip portion of the contacting portion 11, and the first contact part $\mathbf{3}_1$ of the male contact terminals 3 is inserted thereinto. Also, the second insertion portion $S_2$ is formed in a direction orthogonal to the longitudinal direction of the contacting portion 11, and the second contact part $\mathbf{3}_2$ of the male contact terminals 3 is inserted thereinto. The first and second insertion portions $S_1$, $S_2$ will preferably be so formed as to cause the end edges of the elastic tongues 11*a*, 11*b* to bend outward away from each other, so that the gap between the tip portions of the two elastic tongues gradually widens. Such widening of the gap will facilitate insertion of the male contact terminals 3. On the shell portion 10*b* there are formed shoulder portions and latching tabs $\mathbf{10}_1$ that latch onto the positioning-fixing portions of the first and second receiving holes $\mathbf{14}_1$ to $\mathbf{14}_6$ and $\mathbf{16}_1$ to $\mathbf{16}_6$. The latching tabs $\mathbf{10}_1$ possess resilience. The connection portion 12 has a crimping portion 12*b* to which the cores of the lead wires $L_1$ to $L_6$ are crimped, and a fixing portion 12*a* to which the sheathings of the lead wires $L_1$ to $L_6$ are fixed.

The female contact terminals 10 are inserted into, and positioned and fixed inside, certain of the first and second receiving holes $\mathbf{14}_1$ to $\mathbf{14}_6$, $\mathbf{16}_1$ to $\mathbf{16}_6$ provided in the first and second connection portions 14 and 16 of the female housing 13. FIG. 5 shows the state where female contact terminals 10 are inserted into the first connection portion 14's first receiving holes $\mathbf{14}_3$ and $\mathbf{14}_5$ and into the second connection portion 16's second receiving holes $\mathbf{16}_1$, $\mathbf{16}_2$, $\mathbf{16}_4$ and $\mathbf{16}_6$. Positioning and fixing of the female contact terminals 10 is effected using the same methods in both the first and second receiving holes $\mathbf{14}_1$ to $\mathbf{14}_6$ and $\mathbf{16}_1$ to $\mathbf{16}_6$. If, for example, a female contact terminal 10 is inserted into the second receiving hole $\mathbf{16}_2$, the contact terminal 10's latching tab $\mathbf{10}_1$ will latch onto the end portion of the latching piece $\mathbf{16}_L$ and the terminal 10 will thereby be positioned and fixed (see FIG. 6). Removal of the female contact terminal 10 from the receiving hole $\mathbf{16}_2$ is effected by inserting a pointed tool into the detaching hole $\mathbf{14}_0$ and pushing the latching tab $\mathbf{10}_1$ inside the receiving hole $\mathbf{16}_2$ SO as to disengage it from the end portion of the latching piece $16_L$, then pulling the female contact terminal 10 out.

Coupling of the male connector 2 and the female connector 9 will now be described with reference to FIGS. 8 and 9.

To couple the female connector 9 to the male connector 2, first the female contact terminals 10 are inserted into the first receiving holes $14_3$ and $14_5$ of the first connection portion 14 and into the second receiving holes $16_1$, $16_2$, $16_4$ and $16_6$ of the second connection portion 16 in the female connector 9, then the female connector 9 with the contact terminals 10 fitted is connected to the male connector 2. Such coupling inserts the female connector 9's guide protrusions 15*a*, 15*a* into the guide slots $6_2$, $6_2$ in the male connector 2, pushing them down, and thereby connects the six female contact terminals 10 fitted to the first and second connection portions 14, 16 to the six male contact terminals 3 of the male connector 2 (see FIGS. 2 and 5). Although the orientations of the female contact terminals 10 fitted to the first and to the second connection portions 14 and 16 differ, the male contact terminals 3 will be connected to either one of the two (first and second) insertion portions $S_1$ and $S_2$ of the contacting portion 11 of each female contact terminal 10. For example, the first insertion portion $S_1$ of the female contact terminal 10 fitted into the second connection portion 16's second receiving hole $16_2$ will be connected to the first contact portion $3_1$ of the male contact terminal 3. As another example, the second insertion portion $S_2$ of the female contact terminal 10 fitted into the first connection portion 14's first receiving hole $14_5$ will be connected to the second contact portion $3_2$ of a male contact terminal 3. Meanwhile, the female connector 9's female housing 13 is coupled via the latching unit 17. In the foregoing coupling process, the female contact terminals 10 were fitted to the female connector 9 in advance, and then the female connector 9 was coupled to the male connector 2, but alternatively the female contact terminals 10 may be fitted to the female connector 9 after the female connector 9 is coupled to the male connector 2.

Figure 10A:
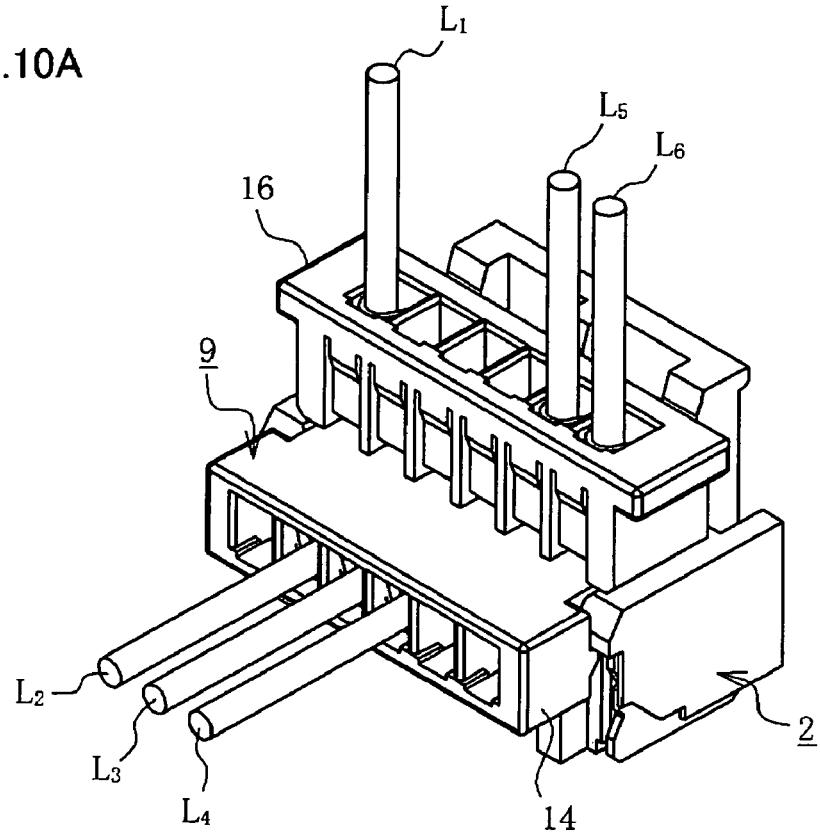
FIG. 10 provides perspective views of the electrical connecting device that show examples of how lead wires can be drawn out.
Figure 10B:
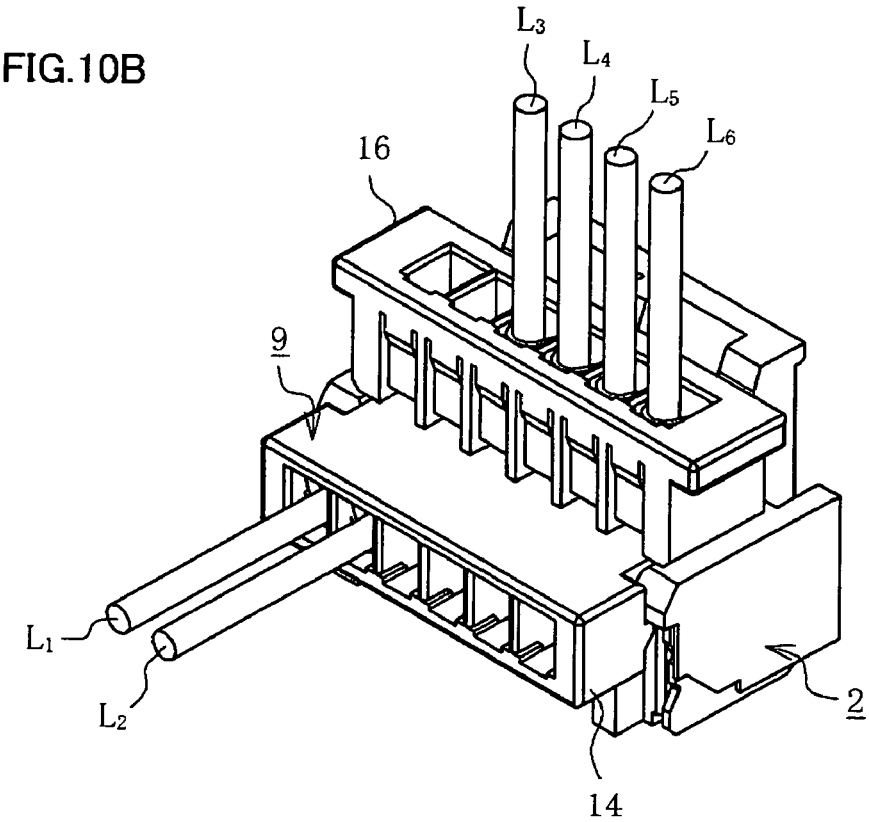
Figure 11A:
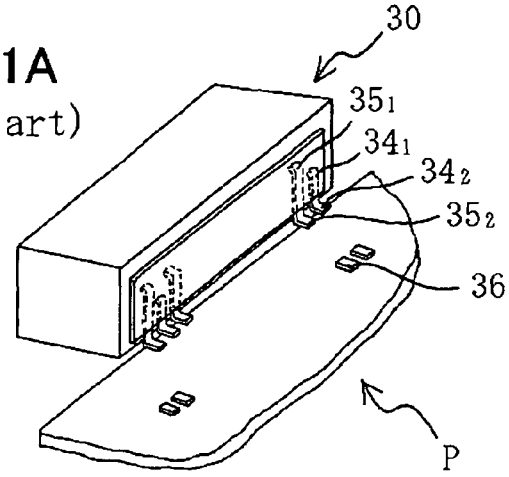
FIG.11A (prior art)
FIG. 11 illustrates electrical connector of the related art, FIG. 11A being overall perspective view of the electrical connector, FIG. 11B being a longitudinal cross-sectional view of the electrical connector in FIG. 11A, and FIG. 11C being a longitudinal cross-sectional view of another electrical connector.
Figure 11B:
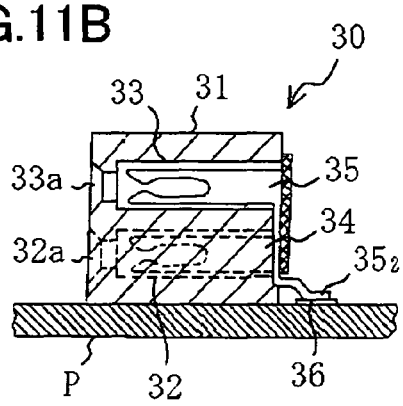
Figure 11C:
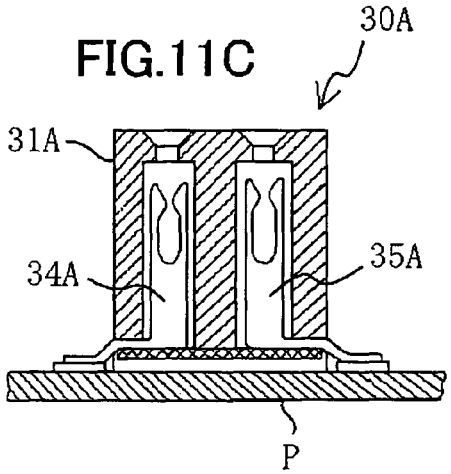
(prior art) FIG.11C

According to this electrical connecting device 1, as FIG. 1 shows, the female contact terminals 10 with lead wires $L_1$ to $L_6$ attached are fitted into the receiving holes $14_1$ to $14_6$ and $16_1$ to $16_6$ of either the first or second connection portions 14, 16 of the female connector 9, and these lead wires $L_1$ to $L_6$ connected to the female contact terminals 10 can be drawn out in a horizontal and/or vertical direction, selected as desired. More precisely, the lead wires $L_3$ and $L_5$ (attached to the female contact terminals 10) that are inserted into the first receiving holes $14_3$ and $14_5$ of the first connection portion 14 can be drawn out in a horizontal direction, and the lead wires $L_1$, $L_2$, $L_4$, and $L_6$ (attached to the female contact terminals 10) that are inserted into the second receiving holes $16_1$, $16_2$, $16_4$ and $16_6$ of the second connection portion 16 can be drawn out in a vertical direction. It is also possible, as FIG. 10A shows, to draw three lead wires out through the first connection portion 14, and three out through the second connection portion 16. Or, as FIG. 10B shows, two lead wires can be drawn out through the first receiving holes $14_1$ and $14_2$ in the left part of the first connection portion 14, and four through the second receiving holes $16_3$, $16_4$, $16_5$ and $16_6$ in the right part of the second connection portion 16. Naturally, it will also be possible to fit the six female contact terminals, with the lead wires $L_1$ to $L_6$ attached, into the receiving holes of either the first or the second connection portion 14 or 16 only.

With this electrical connecting device 1, no matter whether the male connector 2 is installed to an end edge portion or to the central portion of the circuit wiring board, it will be possible, when the female connector 9 is coupled to the male connector 2, to draw the lead wires out from the female connector 9 in a horizontal and/or a vertical direction relative to the plane of the circuit wiring board, and thereby the degree of freedom in the location of installation to the circuit wiring board will be increased. As a result, design of the circuit wiring board will be rendered easier. Also, even after being fitted to the female connector 9, the female contact terminals 10, with the lead wires $L_1$ to $L_6$ attached, can be detached from the female housing 13 in a simple manner, and therefore it will be a simple matter to alter the fitting position, etc., of the female contact terminals 10. By means of such fitting alterations, it will be possible to effect changes in the lead-out directions of the lead wires in a simple manner.

It should be noted that although in the foregoing embodiment the first connector was described as the "female connector" and the second connector as the "male connector", these terms were used merely for the sake of convenience, as according with the shapes of the two connectors in this particular case, and in other cases it would for example be possible to term the first connector the "female connector" and the second connector the "male connector".

What is claimed is:

1. A first connector comprising:

a first contact terminal constituted of a metallic material of good electrical conductivity, having at one end first and second contacting portions and having a lead wire connection portion at an opposite end; and a first connector housing having a first connection portion with a first receiving hole sized and adapted to slidably receive the first contact terminal and a second connection portion that is bent at a certain angle relative to and extending from an end of the first connection portion and having a second receiving hole sized and adapted to receive the first contact terminal, the first connector housing being constituted of an electrically insulative resin molding and internally defining an insertion aperture in communication with the first and second receiving holes to form a bent passageway through the first connector housing, the insertion aperture sized and adapted to receive the first and second contacting portions of the first contact terminal, wherein, if the first receiving hole slidably receives the first contact terminal, the lead wire connection portion is disposed in the first receiving hole, the first and second contact portions are disposed in the insertion aperture and the second receiving hole is empty and, if the second receiving hole slidably receives the first contact terminal, the lead wire connection portion is disposed in the second receiving hole, the first and second contact portions are disposed in the insertion aperture and the first receiving hole is empty.

2. The first connector according to claim 1, wherein the first connector housing is formed in the shape of a letter L when viewed from the side, with the first connection portion being provided in one limb of the L and the second connection portion being formed in the other limb, and with the insertion aperture being provided at the angle portion of the L.

3. The first connector according to claim 1, wherein each one of the first and second receiving holes is defined by respective receiving compartments with inner walls having a particular inner diameter and length, and on the inner walls thereof there are provided latching portions that latch onto the first contact terminal, and release holes for detaching the first contact terminal from the first connector housing.

4. The first connector according to claim 1, wherein the first contacting portion of the first contact terminal is formed as first and second contact tongues having a particular length and width and whose tip portions are disposed so as to oppose each other, either in contact or across a narrow gap, and the second contacting portion of the first contact terminal is formed at the longitudinal tip portion of the first contacting portion so as to be oriented orthogonally to such longitudinal direction.

5. A second connector that is fit-connected to the first connector according to claim 1, comprising:

a second contact terminal constituted of a metallic material of good conductivity and having first and second contact parts that are connected to the first and second contacting portions of the first contact terminal; and a second connector housing that has a base to which multiple second contact terminals are fitted, is mounted and fixed to an installation member, and is constituted of an electrically insulative resin molding;

the second connector housing having a fitting aperture formed in the base, and the second contact terminal being fitted into such fitting aperture in a direction orthogonal to the plane of the base.

6. The second connector according to claim 5, wherein the second connector housing has a latching portion that latches onto the first connector's latching unit.

7. An electrical connecting device comprising:

a first connector, including:

a first contact terminal constituted of a metallic material of good electrical conductivity, having at one end first and second contacting portions that are contact-connected in two directions to a second contact terminal of a second connector, and having a lead wire connection portion at an opposite end; and a first connector housing having a first connection portion with a first receiving hole sized and adapted to slidably receive the first contact terminal, and a second connection portion that is bent at a certain angle relative to and extending from an end of the first connection portion and having a second receiving hole sized and adapted to receive the first contact terminal, the first connector housing being constituted of an electrically insulative resin molding an internally defining an insertion aperture in communication with the first and second receiving holes to form a bent passageway through the first connector housing, the insertion aperture sized and adapted to receive the first and second contacting portions of the first contact terminal; and the second connector that is fit-connected to the first connector including:

a second contact terminal constituted of a metallic material of good conductivity and having a flat configuration; and a second connector housing that has a base to which the second contact terminal is fitted, is mounted and fixed to an installation member, and is constituted of an electrically insulative resin molding;

the second connector housing having a fitting aperture formed in the base, and the second contact terminal being fitted into the fitting aperture in a direction orthogonal to the plane of the base, wherein, if the first receiving hole slidably receives the first contact terminal, the lead wire connection portion is disposed in the first receiving hole, the first and second contact portions are disposed in the insertion aperture with the second contact terminal captured between the first and second contact portions and the second receiving hole is empty and, if the second receiving hole slidably receives the first contact terminal, the lead wire connection portion is disposed in the second receiving hole, the first and second contact portions are disposed in the insertion aperture with the second contact terminal captured between the first and second contact portions and the first receiving hole is empty.

* * * * *

UNITED STATES PATENT AND TRADEMARK OFFICE

CERTIFICATE OF CORRECTION

PATENT NO. : 7,963,777 B2
APPLICATION NO. : 12/314954
DATED : June 21, 2011
INVENTOR(S) : Yann Song Tang et al.

It is certified that error appears in the above-identified patent and that said Letters Patent is hereby corrected as shown below:

Front Page:

Item (75) should read:

-- Inventors: Yann Song Tang, Singapore (SG); Bao Chan Chan, Singapore (SG) --.

Signed and Sealed this
Thirteenth Day of December, 2011

David J. Kappos

David J. Kappos
*Director of the United States Patent and Trademark Office*